United States Patent [19]

Myers

[11] 4,152,585

[45] May 1, 1979

[54] ASSEMBLY FOR THE TRANSPORT OF FUEL ELEMENTS

[75] Inventor: Gordon Myers, Seascale, England

[73] Assignee: United Kingdom Atomic Energy Authority, London, England

[21] Appl. No.: 825,141

[22] Filed: Aug. 16, 1977

[30] Foreign Application Priority Data

Aug. 25, 1976 [GB] United Kingdom ..... 35400/76

[51] Int. Cl.[2] ..... G21F 5/00

[52] U.S. Cl. ..... 250/507; 250/506

[58] Field of Search ..... 250/506, 507, 515; 176/73, 46, 67

[56] References Cited

U.S. PATENT DOCUMENTS

| | | | |
|---|---|---|---|
| 3,845,315 | 10/1974 | Blum | 250/507 |
| 3,962,587 | 6/1976 | Dufrane et al. | 250/507 |

*Primary Examiner*—Bruce C. Anderson

*Attorney, Agent, or Firm*—Larson, Taylor and Hinds

[57] ABSTRACT

An assembly for the transport and storage of nuclear fuel elements comprises a transport flask and a holder for fuel elements which fits within the flask. The assembly has self regulating ullage means which may comprise a plurality of eleongate reservoirs so designed that liquid is maintained in all the reservoirs when the assembly is in either the orientation used to load fuel elements into the assembly or in the orientation used to transport the fuel elements.

2 Claims, 4 Drawing Figures

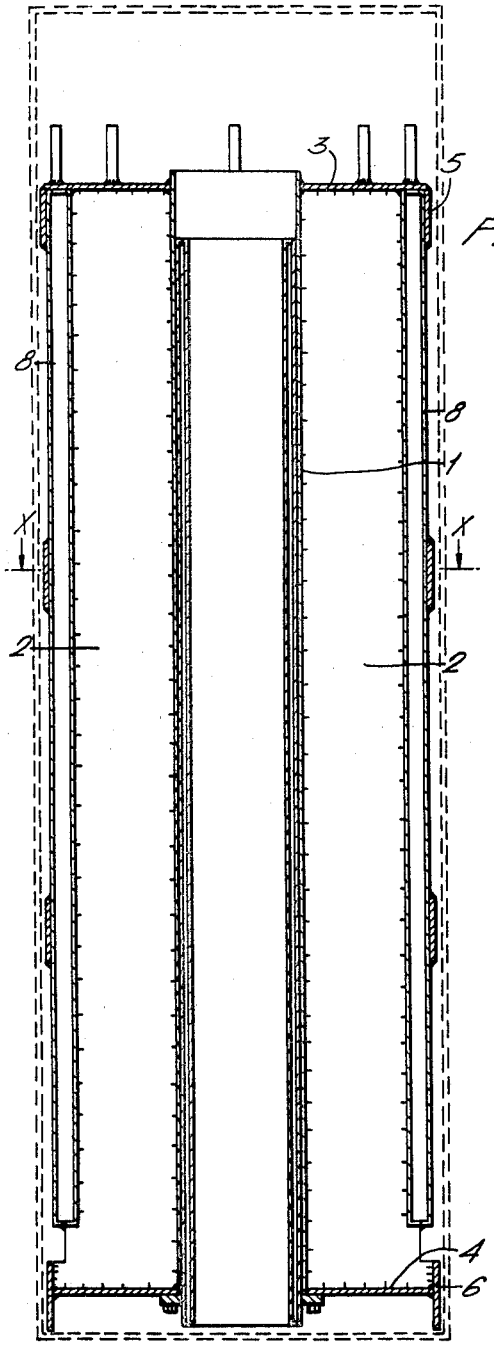
FIG. 1.
FIG. 2
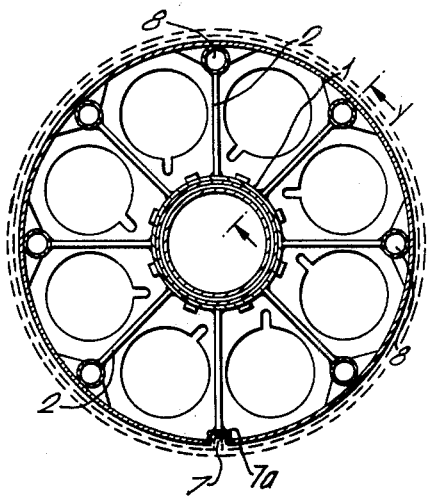

ASSEMBLY FOR THE TRANSPORT OF FUEL ELEMENTS

BACKGROUND OF THE INVENTION

The present invention concerns an assembly for the transport and storage of radioactive fuel elements.

For the conveyance of fuel elements it is known to use sealably closed transportation flasks. During conveyance irradiated fuel elements are submerged in liquid (for example water) within the flask to dissipate heat generated by the decay of fission products and thereby limit the fuel temperature. While provision must be made for change of volume of the liquid in the flask, it is important that irradiated fuel elements are submerged at all times during conveyance.

In British Pat. Specification No. 1378681 there is described and claimed a sealably closable fuel element transportation canister for containing fuel elements submerged in liquid having self-regulating ullage means arranged so that within a chamber for containing the fuel elements the free space can be maintained full of liquid. In particular there is described a canister having a primary chamber for containing the fuel elements submerged in liquid, a secondary chamber for containing liquid and pressurised gas and a duct interconnecting the chambers and arranged for forming an air lock there between whereby the free space in the primary chamber can be maintained full of liquid.

It is now considered that it is not necessary for the chamber containing the fuel elements to be full of liquid although there must be sufficient liquid in the chamber for the fuel elements always to be submerged in the liquid. This condition is important for transportation flasks in which the fuel elements are loaded into the flask in one orientation and the flask is transported in a second orientation.

SUMMARY OF THE INVENTION

Accordingly the present invention provides an assembly for the transport and storage of radioactive fuel elements, comprising a transport flask and a fuel element holder disposed in the flask so that fuel elements in the holder may be submerged in liquid within the flask and the assembly may be used in one orientation for loading the fuel elements and in another orientation for transporting the fuel elements, the assembly having self-regulating ullage means comprising reservoirs for containing liquid and a pressurised gas and the arrangement of the reservoirs being such that in either orientation of the assembly liquid is maintained in all the reservoirs to prevent egress of the pressurised gas therein and to compensate for volume changes arising from temperature variations within the flask.

In a preferred arrangement elongate reservoirs are provided around the fuel element holder.

The reservoirs may each have two communications between the interior and exterior of the reservior, the first of the communications being at the end of the reservior which is lowermost when the assembly is in a vertical position used for loading and being so placed that it is below the level of the liquid in the reservoir when the assembly is in a horizontal position used for transport, the second communication comprising a tube extending from said lowermost end of the reservoir to a point of opening which is above the level of liquid in the reservoir in the vertical position of the assembly used for loading but below the level of liquid in the reservoir or reservoirs in the horizontal position of the assembly used for transport, the tube being shaped to prevent egress of the pressurised gas when the assembly is in the horizontal position.

The assembly may include a basket assembly on which the reservoirs are located. The basket assembly receives the fuel elements which may be enclosed within fuel canisters.

BRIEF DESCRIPTION OF THE DRAWINGS

The invention will be illustrated by the following description of an assembly for the transport and storage of radioactive fuel elements, given by way of example only. The description has reference to the accompanying drawings in which FIG. 1 is an elevation of a basket assembly to receive containers holding fuel elements inside a transportation flask, FIG. 2 is a section along the line X—X in FIG. 1.

DETAILED DESCRIPTION OF A PREFERRED EMBODIMENT

The assembly described below comprises a basket assembly to receive containers holding the fuel elements, the basket assembly being adapted to be received in a transportation flask which is shown diagramatically by dotted lines in FIGS. 1 to 3.

Figure 3:
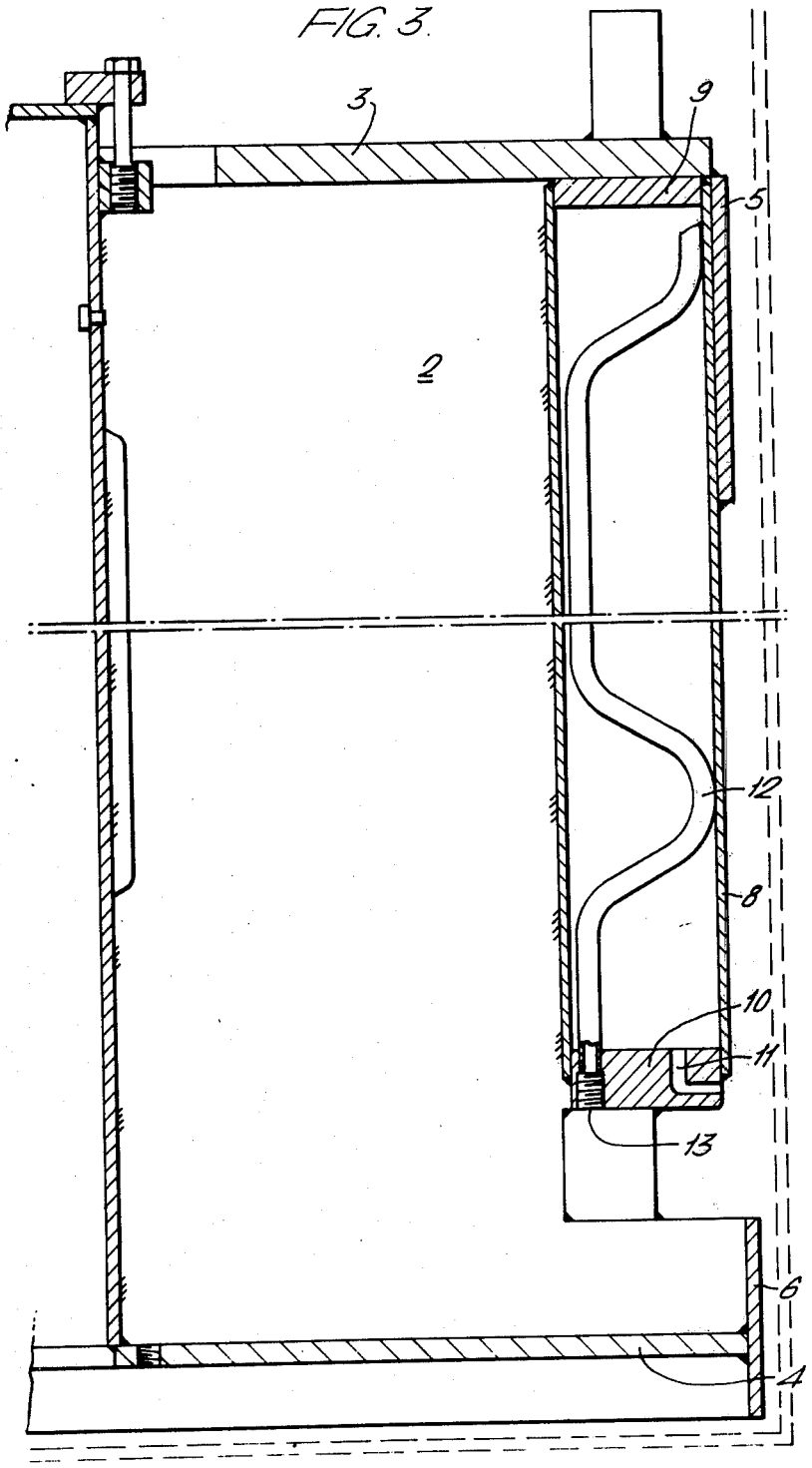
FIG. 3 is a section along the line Y—Y of FIG. 2.

The basket assembly as shown in FIGS. 1 to 3 comprises a central tube 1 having a plurality, in this embodiment eight, of equiangularly spaced apart radial webs 2 welded to the exterior thereof. Top and bottom plates 3 and 4 tie the webs 2 together thereby providing eight compartments about the central tube 1. The top and bottom plates are provided with peripheral skirts 5 and 6 respectively.

A channel-shaped guide 7 is fixedly secured to the outer end of one of the webs 2. The guide 7 extends the full length of the basket assembly and is adapted to slidingly engage a corresponding key *7a* formed on the interior of the flask to accommodate the basket assembly. The co-operating guide and key serve to orientate the basket assembly within the flask.

An ullage tube 8 is fixedly secured to the outer end of each of the remaining webs 2. The ullage tubes extend the length of the web and the ends of each tube are closed by end caps 9 and 10. The lower cap 10 is drilled with an aperture 11 which is positioned to prevent loss of air when the basket assembly is horizontal and immersed in water in the flask but provides a self-draining action when the basket assembly is raised with the flask vertical.

With reference to FIG. 3, it is seen that each ullage tube 8 contains a small bore tube 12. One end of the tube 12 is connected to an aperture 13 in the cap 10. The opposite end of the tube 12 is open and is secured to the wall of the ullage tube 8 at a position such that the open end lies at the bottom of its ullage tube when the basket assembly is in a horizontal position. The tube 12 serves two functions. First, it acts as an air admittance tube to allow draining of the ullage tube when the basket is raised out of the flask with the flask in its vertical position. Second, it ensures that when the basket is horizontal any extra water entering the ullage tube 8 from the flask merely compresses the air already present in the ullage tube. The air is effectively trapped by the 'S' bends in the small bore tube 12 and the location of the apertures 11, 13.

The aperture 11 in the end cap 10 of each ullage tube 8 is orientated with respect to the guide 7 such that when the basket assembly is located within the flask and the flask is horizontal the apertures 11 and the opposite end of the tube 12 are located at or towards the lowermost part of the ullage tube 8.

Figure 4:
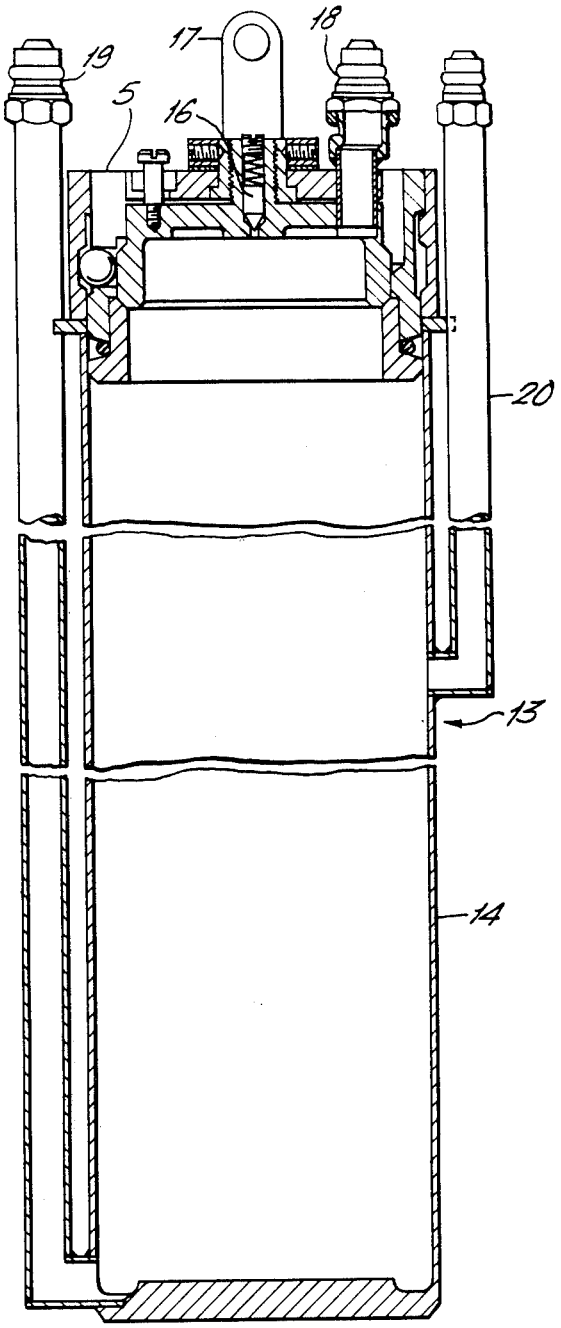
FIG. 4 is a sectional elevation of a container for holding fuel elements.

FIG. 4 depicts a fuel container. The basket assembly illustrated in FIGS. 1 to 3 can accommodate a total of nine such fuel containers, namely one in the central tube 1 and one each in the eight compartments formed by the webs 2. Conveniently, the central tube 1 is provided with a boron carbide annular liner. Each container, 13 comprises a hollow cylindrical body 14 having a lockable lid 15 incorporating a pressure relief valve 16. The lid is provided with a handle 17 and an inlet connection 18 whereby a liquid can be introduced into the container to exit through an outlet 19. The inlet and outlet connections provide a wash through facility. The container is also provided with an ullage tube 20, this being shorter than the outlet tube connection. The handle 17 serves to enable the lid to be screwed into position whilst under water. This screwing operation actuates a ball lock and compresses an O-ring seal. The pressure releif valve can be set to open at a pressure between 200 and 300 psi.

In use, the basket assembly carrying the fuel containers is lowered into and immersed in water in the flask. To enable the basket assembly to enter the flask the guide and key must be in alignment. Water enters the tubes through the apertures 11 to compress the air trapped therein as the basket is lowered into the water.

During transport, the flask will generally be in a horizontal position, there being a normal horizontal position predetermined as to orientation by pads, feet or similar fittings on the exterior of the flask. In this normal horizontal position the arrangement and orientation of the apertures 11, 13 and the opening from the small bore tube 12 in each ullage tube serve to prevent loss of air from the ullage tube. Volume changes arising from temperature variations can result in extra water entering the ullage tubes 8 to further compress the air present therein. As mentioned this air is effectively trapped by the 'S' bends of the tubes 12.

The ullage tubes 8 may have a volume large enough to provide sufficient ullage to accomodate any change in the volume of liquid caused by an increase in temperature. Alternatively an air space may be provided above the liquid in the flask itself to provide some ullage in addition to that provided by the ullage tubes 8. To provide all the ullage required in the form of an air space in the flask would necessitate the construction of excessively large flasks which are expensive to manufacture. Additionally there is a limit to the amount of ullage which can be provided within the flask in this way because it is essential that the fuel elements are submerged under the liquid when the flask is disposed in either of its normal operational orientations. The embodiment described hereinbefore provides ullage in the form of the ullage tubes 8 on the basket assembly. The ullage tubes occupy a position which would normally be unused so the number of fuel elements which can be carried in a particular flask is not reduced.

As the basket assembly is lowered into the liquid in the flask air is trapped in the ullage tubes 8. It is not necessary for the operator to take any action to provide the ullage-in the tubes thus minimising the risk of incorrect operation.

When water is used as the liquid in the transportation flask it acts both as a heat transfer medium and as neutron shielding. The provision of the seven ullage tubes 8 around the fuel elements assists in evenly distributing the water round the fuel elements when the assembly is in its horizontal transport position. This is advantageous particularly for the transportation of highly irradiated fuel elements.

I claim:

1. An assembly for the transport and storage of radioactive nuclear fuel elements comprising:

a transport flask having means for disposing the transport flask in a vertical orientation for loading fuel elements into the flask and in a horizontal orientation for transporting the fuel elements;

holding means for fuel elements disposed within the flask;

a liquid in the flask which submerges any fuel elements in the holding means when the transport container is in the vertical or the horizontal orientation;

a plurality of reservoirs for containing liquid and gas and located around the fuel element holding means;

inlet means on each of the reservoirs to admit liquid to the interior of the reservoir to compensate for any increase in volume of the liquid in the flask arising from temperature variations with the flask, the admission of liquid causing the gas in the reservoirs to be pressurized;

said inlet means comprising an opening in the reservoir providing communication between the interior of the reservoir and the interior of the flask, said opening being located at the end of the reservoir which is lowermost when the flask is in the vertical orientation and being located below the level of liquid in the reservoir when the flask is in the horizontal orientation;

trapping means on each reservoir to prevent egress of the pressurized gas from the reservoirs when the flask is in the vertical or the horizontal orientation;

said trapping means comprising a tube providing further communication between the interior of the reservoir and the interior of the flask, said tube extending from said lowermost end of the reservoir to a position which is above the level of liquid in the reservoir when the flask is in the vertical orientation but below the level of liquid in the reservoir when the flask is in the horizontal orientation and said tube being shaped to prevent egress of pressurized gas when the flask is in the horizontal orientation;

said inlet means and trapping means providing self-regulating ullage means in which liquid is maintained in each of the reservoirs in the vertical and horizontal orientations of the flask.

2. An assembly for the transport and storage of radioactive fuel elements as claimed in claim 1 in which the fuel element holding means comprises a removable basket assembly having compartments in which fuel elements are received, said plurality of reservoirs being located around the basket assembly.

* * * * *